US006491977B1

(12) United States Patent
Doesburg

(10) Patent No.: US 6,491,977 B1
(45) Date of Patent: Dec. 10, 2002

(54) POLYURETHANE COATING SYSTEM

(75) Inventor: Van I. Doesburg, Dalton, GA (US)

(73) Assignee: Textile Rubber & Chemical Company, Inc., Dalton, GA (US)

( * ) Notice: Subject to any disclaimer, the term of this patent is extended or adjusted under 35 U.S.C. 154(b) by 0 days.

(21) Appl. No.: 09/696,567

(22) Filed: Oct. 25, 2000

(51) Int. Cl.[7] ..... B05D 3/12

(52) U.S. Cl. ..... 427/244; 427/355; 427/369; 427/370; 427/373; 427/389.9

(58) Field of Search ..... 427/243, 244, 427/355, 369, 370, 373, 389.9

(56) References Cited

U.S. PATENT DOCUMENTS 4,012,248 A * 3/1977 Rump et al. ..... 156/240
4,132,817 A 1/1979 Tillotson
4,362,774 A * 12/1982 Brandon et al. ..... 427/198
4,512,831 A 4/1985 Tillotson
4,606,944 A * 8/1986 Lauchenauer ..... 162/101
4,715,912 A 12/1987 Tillotson

* cited by examiner

*Primary Examiner*—Shrive P. Beck
*Assistant Examiner*—Kirsten A. Crockford
(74) *Attorney, Agent, or Firm*—Kilpatrick Stockton LLP

(57) ABSTRACT

The present invention relates to a method and apparatus for forming a layer of blown cellular polyurethane on a textile material, such as a carpet backing. The method includes applying to a textile material a layer of reactive polyurethane forming agents containing a sufficient amount of water or heat-sensitive blowing agent so as to cause chemical blowing of the mixture when heated sufficiently, heating the layer so as to cause chemical blowing of the mixture and applying to the layer during the chemical blowing thereof a pressure of an amount and for a time sufficient to control the blowing of the mixture to a desired degree, the pressure being applied to the mixture continuously from an initial pressure to a final pressure, wherein said initial pressure is greater than the final pressure. Apparatus for performing the process is also disclosed.

10 Claims, 2 Drawing Sheets

POLYURETHANE COATING SYSTEM

FIELD OF THE INVENTION

The present invention relates generally to a method and apparatus for forming a layer of blown cellular polyurethane on a textile material, such as a carpet backing. More specifically, the present invention relates to a method and apparatus for providing improved control of properties, such as bond, gauge control and foam density, for blown cellular polyurethane products.

BACKGROUND OF THE INVENTION

U.S. Pat. Nos. 4,132,817; 4,171,395; 4,405,393; 4,512,831; 4,715,912 (the disclosures of which are all incorporated herein by reference) disclose apparatus and processes by which a layer of blown cellular polyurethane; i.e., polyurethane foam, can be formed on a textile material, such as a fabric or carpet back. This process has been used commercially for many years. In the system disclosed in the above-referenced patents, when a relatively heavy blanket weight is applied to the expanding polyurethane reactants, the density of the foam increases and gauge; i.e., foam thickness, is difficult to control. With no blanket weight, the foam and fabric bond is inhibited due to inconsistent contact between the fabric and foam, while at the same time creating a gauge control problem. Furthermore, changes in line speed; i.e., conveyor belt speed, can also influence bond and gauge control. If the conveyor belt speed is reduced, the marriage of the fabric to the reacting foam is slowed and the bond between the two will be relatively weak and inconsistent, or not bonded at all in extreme circumstances. On the other hand, if line speed is increased the foam reaction is effectively slowed down allowing the fabric to marry into the wet chemical mixture, which can result in distortion of the gauge, as well as bleed-through of the chemical into the fabric and incomplete curing of the foam.

Thus, there is a need in the art for a system that provides improved control of the properties of foam-to-fabric bond, gauge and foam density.

SUMMARY OF THE INVENTION

The present invention relates to a method for forming a layer of blown cellular polyurethane on a textile material, such as a carpet backing. The method includes applying to a textile material a layer of reactive polyurethane forming agents containing a sufficient amount of heat-sensitive blowing agent so as to cause chemical blowing of the mixture when heated sufficiently, heating the layer so as to cause chemical blowing of the mixture and applying to the layer during the chemical blowing thereof a pressure of an amount and for a time sufficient to control the blowing of the mixture to a desired degree, the pressure being applied to the mixture continuously from an initial pressure to a final pressure, wherein said initial pressure is greater than the final pressure.

In another embodiment, there is an apparatus for forming a layer of blown cellular polyurethane on textile material. The apparatus comprises a continuous conveyor belt upon which a quantity of reactive polyurethane forming agents can be deposited, a mixer for mixing reactive polyurethane forming agents and depositing them on the conveyor belt, a means for applying a textile material to the polyurethane forming agents deposited on the belt, a means for heating the polyurethane forming agents deposited on the belt, and a means for applying a plurality of different pressures to the textile material and polyurethane forming agents deposited on the belt during the chemical blowing thereof.

Accordingly, it is an object of the present invention to provide an improved method and apparatus for forming a layer of blown cellular polyurethane on a textile material; particularly, a carpet back.

Another object of the present invention is to provide an improved method and apparatus that can apply a plurality of different pressures to a layer of reactive polyurethane forming agents during the chemical blowing thereof.

These and other objects, features and advantages of the present invention will become apparent after a review of the following detailed description of the disclosed embodiments and the appended drawing and claims.

BRIEF DESCRIPTION OF THE DRAWING

FIG. 2 is a detailed schematic view of the weight blanket portion of the apparatus shown in FIG. 1.

DETAILED DESCRIPTION OF THE DISCLOSED EMBODIMENTS

Figure 1:
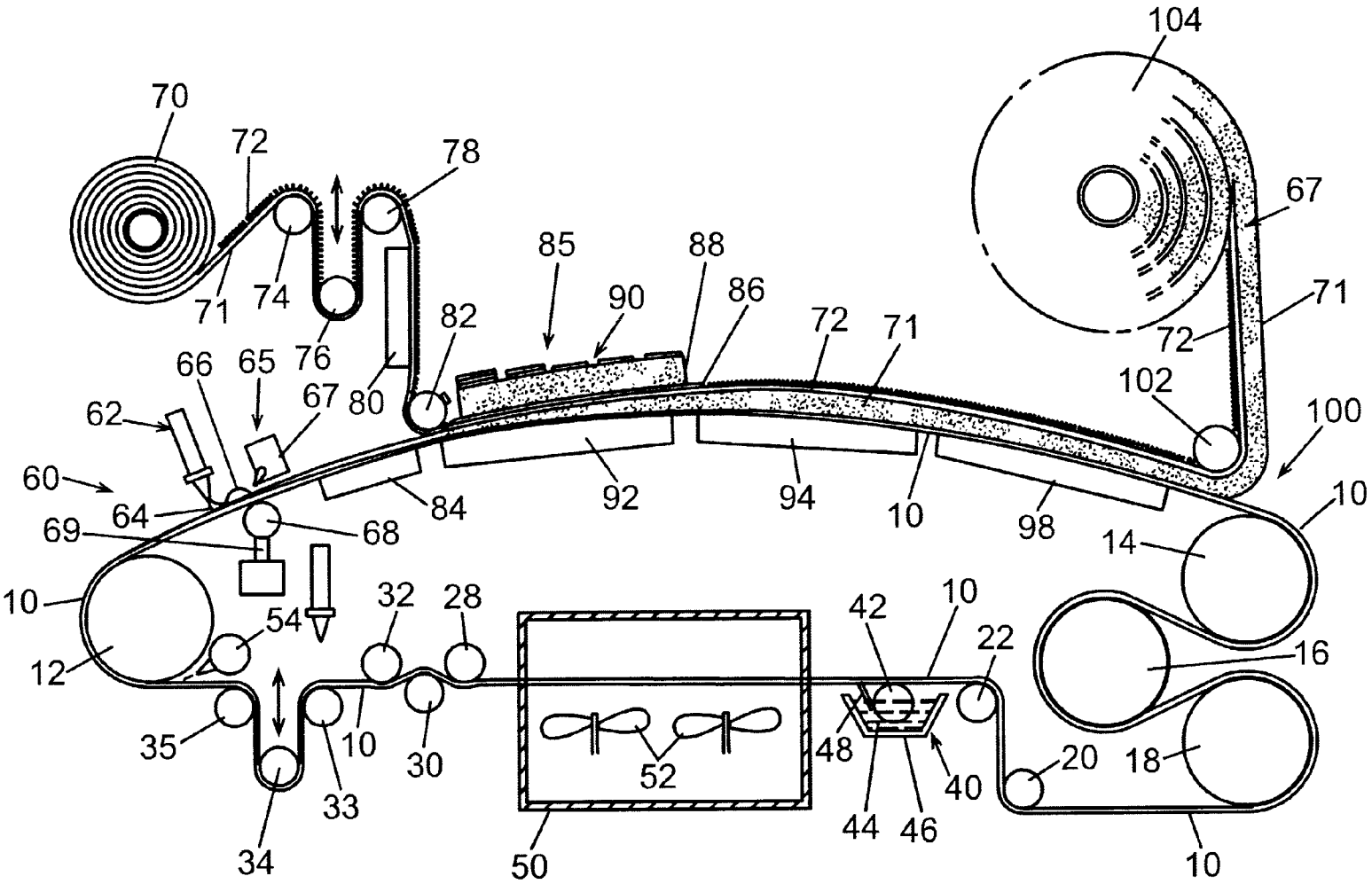
FIG. 1 is a schematic diagram of apparatus for forming a layer of blown cellular polyurethane on a carpet backing fabric embodying principles of the invention.
Figure 7:
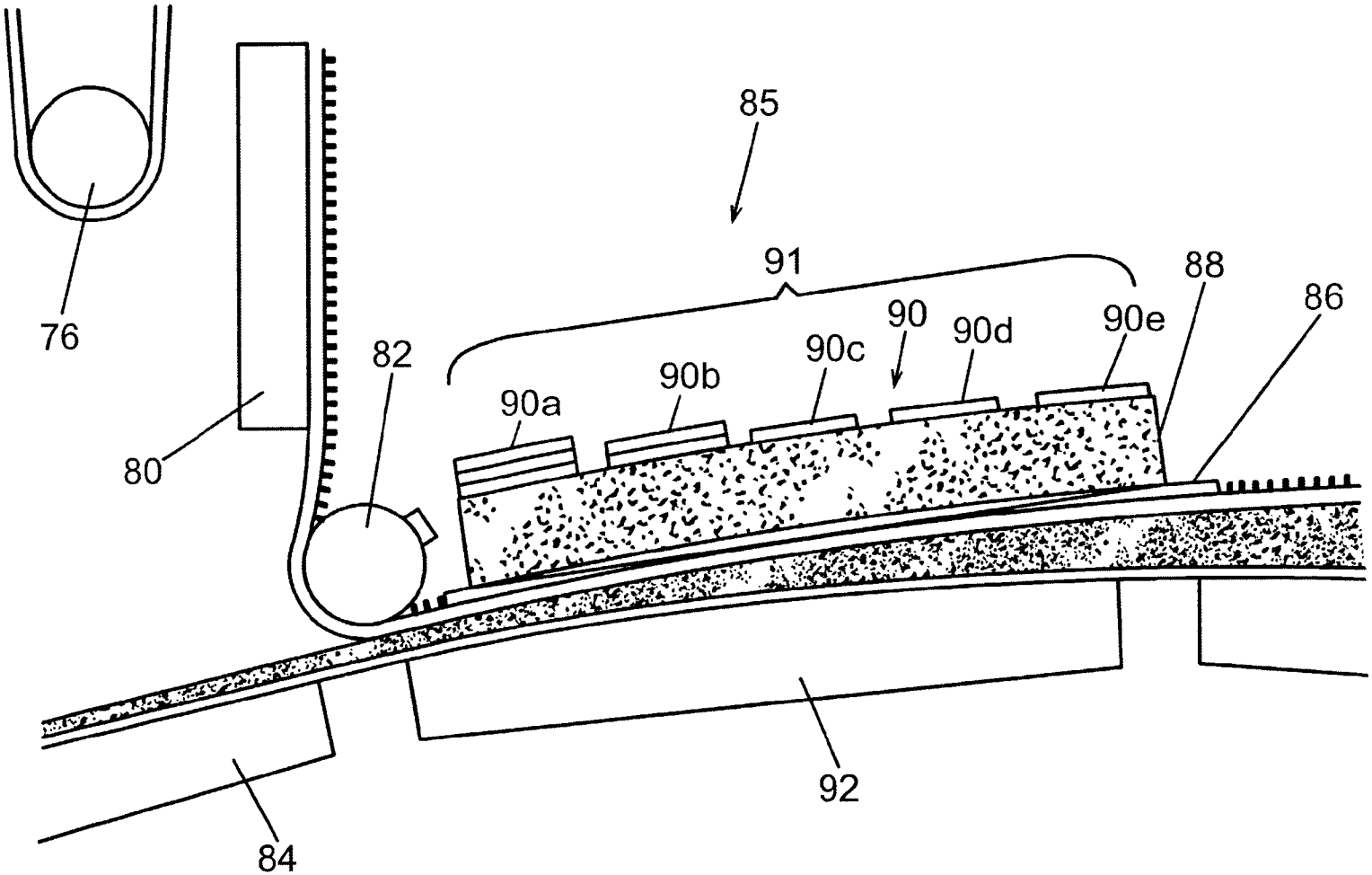

Referring now in more detail to the drawing in which like number indicate like elements throughout the several views, there is shown apparatus comprising an endless conveyor belt 10 extending along an endless conveyor path over four drive rollers 12, 14, 16 and 18 which are driven by an electric motor (not shown), idler rollers 20 and 22, belt guide rollers 28, 30 and 32 and belt tensioner rollers 33, 34 and 35 (FIG. 1). The speed of the belt 10 is variably controllable to adjust to varying manufacturing needs. Generally, for producing carpet belt speeds that are useful in the present invention are between about 20 and 80 feet per minute, preferably between about 25 and 60 feet per minute. Other speed can also be used depending on the product that is being manufactured.

From the drive roller 14, the conveyor belt, which preferably is constructed from Teflon coated fiberglass, is seen to pass around the drive rollers 16 and 18. The belt 10 is then delivered by the idler rollers 20 and 22 to a film coating station 40 comprising an applicator roller 42 partially submerged in a liquid elastomeric composition mixture 44 in a trough 46. The mixture comprises an ethylene vinyl acetate latex, surfactants, a thickener, a flame retardant and an internal lubricant. A doctor blade 48 is positioned downstream of the applicator roller 42 to control the thickness of the film as it is coated onto the belt by wiping off any excess which then flows down the blade back into the trough. The film on the coated belt 10 is then dried in a circulating hot air dryer 50 in which a series of fans 52 are rotatably housed. The dried elastomeric film has a thickness of from about 0.0005 inches to 0.002 inches, preferably about 0.001 inch and a weight per square yard of from about 0.4 ounces to 2 ounces, preferably about 0.9 ounces. The belt 10 with the dried elastomeric film thereon is then passed over the belt guide rollers 28, 30 and 32 to properly position the belt in preparation for polyurethane deposition. Alternately, the elastomeric film may comprise a layer of an olefin material, such as polyethylene or polypropylene, or a layer of polyvinyl chloride or rubber lattices, such as natural or synthetic styrene-butadiene rubber (SBR) latex. In addition, the elastomeric film may be extruded onto the belt rather than formed in situ.

With continued reference to the drawing, the conveyor belt 10 with the dried elastomeric film thereon is seen to pass over the idler roller 33, the belt tension adjusting roller 34, which is movable in a vertical direction, the idler roller 35 and the drive roller 12. After the film is dried and before the polyurethane reactants are deposited on the belt at a deposition station 60, the temperature of the belt is optionally brought to between about 50° and 120° F., preferably about 75° F., by blowing chilled, dry air on the belt from a belt cooler 54. The belt cooler 54 comprises a perforated pipe which extends transversely across the entire width of the conveyor belt 10 and is arranged so as to direct chilled, dry, forced air to both the underside of the conveyor belt 10 and the drive roll 12.

The polyurethane deposition station 60 includes a traversing mixer 62 having the mouth of a downwardly extending spout 64 disposed above the conveyor belt 10. Polyurethane reactants comprising at least one polyol, at least one isocyanate, water and a suitable catalyst are dispensed into the mixer 62. The mixer 62 has a traverse time of about one and one-half seconds per pass across the conveyor belt 10. The polyurethane reactants and the traversing mixer 62 are cooled so that the temperature of the mixed reactants, as they emerge from the mixer, may be maintained at from about 60° to 100° F., preferably about 75° F. In order to assure a uniform lay down of reactants onto the film-coated belt, the end of the mixer nozzle is positioned from about 0.25 inch to 4 inches, preferably about 1.0 inches above the belt. Additionally, the centerline of the mixer nozzle is positioned from about 1 inch to 6 inches, preferably about 2 inches, upstream from a spreading device.

The deposited polyurethane mixture is then smoothed and spread into a reactive layer by an air knife 65 located at the deposition station but downstream from the mixer spout. The air knife comprises a compressed air jet stream that is directed toward the puddle of deposited reactants 66 by means of a rectangular slot (not shown) in a conduit 67. The slot has an opening of from about 0.005 inches to 0.100 inch, preferably about 0.025 inches wide. Air at a pressure of from about 20 ounces to 130 ounces, preferably about 60 ounces to 120 ounces per square inch, is emitted from the slot. The outlet of the slot is positioned about 0.05 inches to 2.0 inches, preferably about 0.375 inches from the belt and has an angular position relative to the belt so that the air jet impinges the belt with an inclined angle between the air stream and the belt of from about 10° to 60° ; preferably from about 20° to 35°. To further control the rate of reaction of the polyurethane reactants, the air jet temperature is controlled between about 50° and 120° F., preferably about 80° F.

In order to aid in uniform spreading of the reactants onto the film-coated belt, the belt 10 is flattened by applying a linear force to the belt of from about 1 pound to 10 pounds, preferably about 5 pounds per inch of belt width and then drawing the tensioned belt over a ledger bar 68 positioned immediately below the air knife 65. This tensioning operation is accomplished by means of the belt tension adjusting roller 34 for adjusting the tension on the belt between the roll and the ledger bar. To assure uniform separation of the conveyor belt 10 and the air knife 65, the ledger bar 68 is adjustably mounted on jackscrews 69 which raise of lower the ends of the ledger bar.

Simultaneous with the deposition of polyurethane reactants onto the conveyor belt, a carpet 70 of conventional tufted or woven construction, with exposed tufted looped backs or exposed weave strands in a backing fabric 71, is dispensed from a carpet supply roll. The carpet backing from which face yarn 72 freely extends is passed over the idler roller 74, the tension adjusting roller 76, which is movable in a vertical direction, and the idler roller 78. The carpet 70 is then fed over a heater 80 which heats the backing to a temperature of between about 100° and 300° F., preferably between about 140° and 180° F. The fabric backing is then fed under a marriage bar 82 to tension the backing as it passes over the heater and marry the backing to the layer of polyurethane reactants.

In order to control the amount of reactant mixture that penetrates into the applied fabric and to control the amount of gas that is generated by the portion of the mixture which is deposited in the spaces between the loop backs of the fabric, it is very important to partially react the mixture to a closely controlled degree before the heated backing fabric is applied. This is done by passing the belt over a reactant preheater 84 which is positioned between the ledger bar 68 and the marriage bar 82. Sufficient heat is applied so that the temperature of the layer of reactants is maintained at about 100° to 200° F., preferably from about 130° to 155° F., at the precise time the heated backing fabric 71 is applied to the reactant mixture.

After the carpet has been heated and linearly tensioned, its backing fabric is brought into flush contact with the layer of polyurethane forming reactants by passing the carpet under the marriage bar 82. The speed of the ladened conveyor belt and of the carpet backing are set so that they pass through the polyurethane forming station 85 at the same velocity.

Immediately after the heated backing fabric is applied to the partially reacted polyurethane, it is necessary to press the backing fabric against the reactants with a force of about 0.2 ounces to 5 ounces, preferably about 0.5 ounce to 2 ounces per square inch, for part or all of the time that gas is being evolved by the reactive mixture, i.e., from about 1 to 100 seconds, preferably about 30 to 50 seconds. This is accomplished by drawing the ladened belt under a blanket of predetermined weight. The blanket comprises a low friction fabric 86, preferably Teflon coated fiberglass, which rides over the face yam 72 of the carpet, a layer of load distributing foam 88, preferably polyurethane foam, disposed on the low friction fabric and a load of thin metal sheets 90 disposed on top of the load distributing foam. The low friction fabric is fastened at one end so that the blanket pressure is applied to the carpet immediately after the carpet fabric backing is applied to the polyurethane reactants.

In U.S. Pat. No. 4,132,817 (the disclosure of which is incorporated herein by reference) the weight that is applied to the backing fabric during gas evolution of the polyurethane foam is uniformly distributed over the length and width of the weighted blanket and from the beginning of the weighted blanket to the end. It has now been discovered as a part of the present invention that better control of fabric-to-foam bond, gauge control and foam density can be achieved by providing an uneven distribution of weight to the weighted blanket in the direction that the carpet product or conveyor belt 10 is moving.

With reference to FIG. 2, it can be seen that there is gas evolution section as indicated at 91. The gas evolution section 91 is that section of the process illustrated during which the polyurethane reactants are producing gas to form the cellular structure of the foam, as opposed to merely curing the foamed reactants. Within this gas evolution section 91, the weighs 90 that are applied to the weighted blanket are heavier at the initial contact of the weighted blanket and the carpet backing than downstream of that location adjacent where the weighted blanket ends. As shown in FIG. 2, the weights 90 that are applied to the foam 88 that rests on the low friction fabric 86 are divided into five separate zones. The first zone 90*a* comprises three rectangular plates, the second zone 90*b* includes two rectangular plates, and the third zone 90*c*, fourth zone 90*d* and fifth zone 90*e* each include one rectangular plate. Each of the rectangular plates in each of the zones 90*a*–90*e* is of the same dimensions, is made of the same material and is of the same weight. Therefore, the weight applied by the first zone 90*a* is three times as much as each of the third, fourth and fifth zones 90*c*–90*e* and the second zone 90*b* is twice as heavy as each of the third, fourth and fifth zones 90*c*–90*e*. Although the present invention has been illustrated as applying weight to the foam 88 and fabric 86 in five different weight zones, it is specifically contemplated that greater or fewer numbers of pressure zones may be used. It is an essential element of the present invention that pressure is applied to the foam 88 and fabric 86 throughout its length and that the initial pressure is at least about twice as much as the final pressure, preferably about three times as much.

During the time that the reactants are evolving gas, it is most important to control their temperature in order to prevent collapse of the foam. This is done by adjusting the temperature of a reactant heater 92 and a pre-cure heater 94 so that the reactants are raised to a temperature of from about 120° to 220° F., preferably from about 160° to 215° F., and held at that temperature for a period of from about 15 seconds to 120 seconds, preferably about 50 seconds to 75 seconds.

After completion of gas evolution, the coated carpet 70 is heated for an additional time to affect the desired cure of the polyurethane foam. This is accomplished by passing the ladened belt over a cure heater 98 to raise the temperature of the foam to about 150° to 350° F., preferably about 250° to 300° F. Optionally, this final heat-curing step may be done after the composite is stripped from the carrier belt or partially before and partially afterward.

Finally, the carpet, together with the blown cellular polyurethane layer and elastomeric film, is stripped from the belt at the exit 100 of station 85, fed over a stripper roll 102 and onto a take-up reel 104.

It should be noted that the polyurethane reactive mixture is deposited onto the belt 10 while the belt is moving in a substantially convex path from the drive roller 12, and maintained in that convex configuration during chemical blowing and curing of the foam as the belt 10 passes over the series of heated platens 84, 92, 94 and 98 until stripped from belt 10 at exit 100 of station 85. It has been found that by depositing the polyurethane reactants onto the belt 10 and maintaining the belt in that convex configuration until final curing, it is possible to eliminate longitudinal wrinkles in the carpet fabric and final product. Therefore, the series of heated platens 84, 92, 94 and 98 are arranged so as to form a relatively smooth continuous convex path for the belt 10 as it passes from the drive roll 12 to the drive roll 14.

The final product includes face yarn tufted or woven into a primary carpet backing, a layer of cellular polyurethane on the undersurface of the backing and loop backs of yarn, and a thin elastomeric film on the cellular polyurethane; i.e., polyurethane foam.

The precise nature of the formulation which forms the elastomeric film on belt 10 at film coating station 40 or the polyurethane formulation which forms an integrally bonded polyurethane cushion for the carpet product is not critical to the present invention. A mixture of ethyl vinyl acetate latex and standard compounding additives have been mentioned and it should be obvious that other film-forming materials and lattices will function equally as well. The polyurethane material is a polymerization product of a mixture of at least one polyol, at least one isocyanate, water and a catalyst system that promotes a polymerization reaction between the isocyanate and the polyol to form the polyurethane. A polyol, which is suitable for use in the present formulation, is the reaction product of a polyol that has been modified by polymerization with either styrene or acrylonitrile or both in the polyol. The degree of modification of the polyol should be from about 10% to 100%, preferably about 40% to 60%. While the presence or absence of this particular polyol in no way affects the performance of the process, it makes a pronounced improvement in the physical properties of the product. Load bearing capabilities and rate of recovery from deformation are greatly enhanced. Blowing of the polyurethane composition is affected by controlling the catalyst system, the water concentration and the isocyanate level. Generally, water is present in the reaction mass from between about 0.01 to 5.0 parts per hundred parts polyol, preferably 2 parts to 4 parts, over and above the water normally present in the reaction mixture. The catalyst system not only must affect rapid curing, but also must control formation of carbon dioxide resulting from the reaction of water and isocyanate. Blowing should be controlled to affect expansion between about 500% and 6400%, preferably between about 800% and 3000%, so that a carpet yarn loop back stitch is saturated with reactants and the reactants expand sufficiently prior to curing. Suitable catalysts are those which promote polyurethane formation and concurrently promote the blowing reaction. Preferred catalysts are organic metal compounds, amines, and metal soaps; such catalysts include dibutyl tin dilaurate and stannous octoate.

Suitable additional polyols which may be employed in the present invention are the polyether polyols, having a functionality of at least two, an average molecular weight between about 1000 and 9000 and a hydroxyl number less than 100. Such polyols include polybutylene glycol, polyethylene glycol, polypropylene glycol, 1,2-polydimethylene glycol, polydecamethylene glycol and mixtures thereof. Preferred polyols have an average molecular weight of between about 2000 and 6000, and particular preferred polyols have a molecular weight of between about 3000 and 5000.

A variety of isocyanates may be reacted with the polyols to obtain satisfactory blown polyurethane cellular coatings. Particularly suitable isocyanates are aromatic diisocyanates as they are more reactive and less toxic than the aliphatic diisocyanates. Such diisocyanates include 2,4-toluene diisocyanate, 2,6-toluene diisocyanate, methane diisocyanate, napthylene 1,4-diisocyanate, diphenylmethyl-4,4'-diisocyanate, 3,3'-dimethoxy biphenylene diisocyanate, 4,4'-diphenylene diisocyanate, 4,4' diphenylmethane diisocyanate, 2,2' diphenylmethane diisocyanate, polymethylene polyphenyl diisocyanate, and mixtures thereof. The isocyanate usually is employed in stoichiometric excess to assure complete reaction with the functional groups of the polyol and with the water which is present. Preferably the ratio of isocyanate groups to the active hydrogen groups in the polyol mixture is between 0.9 and 1.20.

With this method carpet cushion can be formed in situ on a backing fabric with the cellular polyurethane having a density of between about 1 and 12 pounds per cubic foot, a thickness of between about 1/16 of one inch and one inch, and a homogeneous cell structure substantially free of cells having a diameter larger than 1/4 inch.

The following examples are illustrative of the present invention and are not intended to limit the scope of the invention as set forth in the appended claims.

EXAMPLE 1

A carpet is prepared using a laboratory scale apparatus described above.

The belt speed was held constant at 5 feet per minute. Another variable kept constant was the marriage point. The marriage point is the point at which the chemical reaction of the poyol/isocyanate blend is at the "gel" stage of the reaction and the fabric is at a temperature conducive for proper bonding (110°–200° F.). Moving the marriage point forward or backward will affect the bonding and gauge of the composite in much the same way as increasing or decreasing the conveyor belt speed, as described above.

Individual metal plates 6 inches ×25 inches ×1/16 inch weighing 0.275 oz/in$^2$ were placed on the foam 88 riding on the fabric 86 to thereby form the pressure blanket. Different numbers of plates were placed in the piles 90*a*–90*e* to determine the effect of different weight arrangements on the bond, gauge and foam density of the polyurethane. As designated herein, the number of weights in the five consecutive zones will be shown as, for example 1,1,1,1,1 if one weight were placed in each pile 90*a*–90*e*.

The first weight configuration investigated was a 0,0,0,0,0 weight arrangement giving a uniform pressure of 0.024 oz/in$^2$ due to the weight of the blanket fabric. Using this formation, there were several noticeable problems with the carpet/foam composite. Between the foam/fabric interface, there were voids observed in a random pattern. Without constant contact with the fabric, the foam can expand uncontrollably in some areas causing a gauge differential. This gauge differential ranged from 0.250 inches to 0.406 inches with a desired target of 0.375 inches. In the areas where no contact was made between the foam and fabric, the polyurethane foam had a smooth, glossy surface. In comparison, when contact was made with the fabric, the surface of the foam had indentations of the fabric pattern along with a dull, cellular appearance. It was also detected that with no weight on the marriage assembly, friction between the fabric and foam caused the cells of the foam to collapse in high friction areas giving rise to a density difference in small pockets throughout the composite.

The second weight configuration investigated was 1,2,2, 2,2 (0.299, 0.57, 0.57, 0.57, 0.57 oz/in$^2$). The adhesive bond of the polyurethane foam to fabric was inconsistent. There were several areas in each processed composite that had a weak bond in sporadic placements. Within those areas, there were indications of no contact between the fabric and foam similar to the areas in the first configuration. Even when the foam and fabric stay in contact with one another, the bond was weaker in some sections than it was in other areas.

The third weight arrangement was to use a 20 inch×25 inch solid aluminum plate. This set-up as described in U.S. Pat. No. 4,132,817 was measured to give a constant pressure of 0.8 oz/in$^2$.

This plate was used to apply constant heavy pressure throughout the critical process of marrying the fabric to the foam. The predominant issue using this configuration was the gauge reduction that resulted. When the solid plate was applied to the marriage assembly, an instantaneous reduction in gauge swing of 0.188 to 0.281 inches was recorded. It was observed that a "puddle" build-up developed at the marriage point where the fabric met the foam. This build-up would exhaust itself once the chemical reaction reached a point where it began to make a viscous fluid. It would then repeat the cycle. The density of the foam was measured on the lower gauge material and compared with the correct gauged material. The density ranged from 3.5 to 3.75 lbs/ft$^3$ using the heavy plate.

The final configuration consisted of a 3,2,1,1,1 (0.84, 0.57, 0.299, 0.299, 0.299 oz/in$^2$) set-up. Using this arrangement, all of the previously mentioned problems were no longer present. A consistent bond was made between the foam and fabric. The bond was strong and no voids were found throughout the composite. A consistent gauge of 0.375 throughout the composite was seen. The density ranged from 3.1 to 3.3 lbs/ft$^3$.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A method of forming a layer of blown cellular polyurethane on textile material comprising:

a. applying to said textile material a layer of reactive polyurethane forming agents containing sufficient water to cause chemical blowing of the mixture when heated sufficiently;

b. heating the layer so as to cause chemical blowing of the mixture;

c. applying to said layer during the chemical blowing thereof a pressure of an amount and for a time sufficient to control the blowing of the mixture to a desired degree, said pressure being applied to said mixture continuously from an initial pressure to a final pressure, wherein said initial pressure is at least approximately two times greater than the final pressure.

2. The method of claim 1, wherein the initial pressure is up to three times greater than the final pressure.

3. The method of claim 1, wherein the initial pressure is approximately three times greater than the final pressure.

4. The method of claim, 1 wherein the pressure is sufficient to prevent incomplete bonding of the foam to the textile material.

5. The method of claim 1, wherein the pressure is insufficient to undesirably reduce the gauge of the foam.

6. The method of claim, 1 wherein the textile material is a carpet backing material.

7. A method of forming a layer of blown cellular polyurethane on textile material comprising:

a. applying to a continuous belt a quantity of reactive polyurethane forming agents containing sufficient water to cause chemical blowing of the mixture when heated sufficiently;

b. heating the layer so as to cause chemical blowing of the mixture;

c. applying to said reactants layer during the chemical blowing thereof a layer of textile material;

d. applying to said reactants layer during the chemical blowing thereof a pressure of an amount and for a time sufficient to control the blowing of the mixture to a desired degree, said pressure being applied to said mixture continuously from an initial pressure to a reduced final pressure, wherein said initial pressure is at least approximately two times greater than the final pressure, whereby said reactants layer forms a cellular polyurethane bonded to the textile material and the foam layer has a desired gauge.

8. The method of claim 7, wherein the pressure is applied to the reactants layer in a series of zones.

9. The method of claim 8, wherein there are five successive pressure zones.

10. The method of claim 9, wherein the first zone exerts about three times the pressure of each of the last three zones and the second zone exerts about twice the pressure of each of the last three zones.

* * * * *